US010272287B1

(12) United States Patent
Rector

(10) Patent No.: US 10,272,287 B1
(45) Date of Patent: Apr. 30, 2019

(54) POST-MOUNTABLE EXERCISE APPARATUS

(71) Applicant: Michael A. Rector, Newbury Park, CA (US)

(72) Inventor: Michael A. Rector, Newbury Park, CA (US)

( * ) Notice: Subject to any disclaimer, the term of this patent is extended or adjusted under 35 U.S.C. 154(b) by 0 days.

(21) Appl. No.: 16/154,970

(22) Filed: Oct. 9, 2018

(51) Int. Cl.

| | |
|---|---|
| ***A63B 21/00*** | (2006.01) |
| ***A63B 21/04*** | (2006.01) |
| ***A63B 21/16*** | (2006.01) |
| ***A63B 22/06*** | (2006.01) |
| ***A63B 21/015*** | (2006.01) |

(52) U.S. Cl.
CPC .... *A63B 22/0694* (2013.01); *A63B 21/00069* (2013.01); *A63B 21/015* (2013.01); *A63B 21/0414* (2013.01); *A63B 21/16* (2013.01); *A63B 22/0605* (2013.01)

(58) Field of Classification Search
CPC ... A63B 21/00069; A63B 22/06; A63B 21/16; A63B 21/01; A63B 21/041
See application file for complete search history.

(56) References Cited

U.S. PATENT DOCUMENTS 3,572,699 A * 3/1971 Nies ..... A61B 5/221 482/5
4,071,235 A * 1/1978 Zent ..... A63B 22/001 482/62
4,140,312 A * 2/1979 Buchmann ..... A63B 22/0007 482/62
4,225,130 A * 9/1980 Zimmerman ..... A63B 22/0007 482/60
4,358,109 A * 11/1982 Schrems ..... A63B 21/4029 482/142
4,881,732 A * 11/1989 Kepiro ..... A63B 22/001 482/62
4,902,002 A * 2/1990 Huang ..... A63B 22/0012 482/62
5,039,092 A * 8/1991 Olschansky ..... A63B 21/04 482/130
5,044,627 A * 9/1991 Huang ..... A63B 22/0002 482/115
5,050,869 A * 9/1991 Frate ..... A63B 21/154 482/904
5,160,305 A * 11/1992 Lin ..... A63B 23/00 482/138
5,161,430 A * 11/1992 Febey ..... B62M 3/02 74/594.1
5,269,736 A * 12/1993 Roberts ..... A63B 23/03516 482/51

(Continued)

*Primary Examiner* — Garrett K Atkinson
(74) *Attorney, Agent, or Firm* — Louis Ventre, Jr.

(57) ABSTRACT

A post-mountable exercise apparatus includes an exercise device, a 3-walled bracket and a bridge. The exercise apparatus is attachable to a post by surrounding the post with the 3-walled bracket and bridge, which tighten together in place on the post. The exercise device has a frame that supports a horizontal shaft rotatably mounted in the frame such that two crank arms extending outside the first side and the second side of the frame can be rotated to turn the horizontal shaft. A band tensioning device using a threaded member may be added so that tightening or loosening the threaded member causes a change in the tension of the pliant band and resistance of the exercise device to being rotated.

6 Claims, 5 Drawing Sheets

(56) References Cited

U.S. PATENT DOCUMENTS

| | | | | | |
|---|---|---|---|---|---|
| 5,330,402 | A * | 7/1994 | Johnson | A63B 22/0012 | 482/52 |
| 5,514,053 | A * | 5/1996 | Hawkins | A63B 21/15 | 482/63 |
| 5,569,128 | A * | 10/1996 | Dalebout | A63B 22/0007 | 482/57 |
| 5,857,943 | A * | 1/1999 | Murray | A63B 22/0012 | 482/57 |
| 6,036,623 | A * | 3/2000 | Mitchell | A63B 23/03575 | 482/57 |
| 6,592,498 | B1 * | 7/2003 | Trainor | A63B 21/153 | 482/46 |
| 6,689,025 | B2 * | 2/2004 | Emick | A63B 21/04 | 482/121 |
| 7,510,512 | B1 * | 3/2009 | Taggett | A63B 21/0088 | 482/111 |
| 7,789,808 | B2 * | 9/2010 | Lee | A63B 22/0007 | 482/57 |
| 8,636,628 | B1 * | 1/2014 | Greene | A63B 21/4029 | 482/142 |
| 8,968,162 | B2 * | 3/2015 | Jaguan | A63B 71/023 | 482/57 |
| 2003/0232706 | A1 * | 12/2003 | Emick | A63B 21/04 | 482/123 |
| 2005/0054499 | A1 * | 3/2005 | Davies, III | A61H 1/0229 | 482/131 |
| 2005/0266964 | A1 * | 12/2005 | Teng | A63B 22/0061 | 482/71 |
| 2007/0197350 | A1 * | 8/2007 | Gonzalez | A63B 69/004 | 482/83 |
| 2008/0234112 | A1 * | 9/2008 | Hernandez | A63B 21/012 | 482/63 |

* cited by examiner

POST-MOUNTABLE EXERCISE APPARATUS

TECHNICAL FIELD

In the field of exercise devices, a portable exercise machine that may be connected to a post in a gym or other location and used to condition or develop muscles employed while the user imitates foot or hand-pedaling of a bicycle-type rotary apparatus.

BACKGROUND ART

A portable exercise device that easily connects and disconnects to a post or pole with a clamping device that surrounds the post and thereby provides a substantial area of contact to resist movement once tightened against the post, is not known. There have been attempts at portability using two sides of the vertical edge of a door, a wall or other thin vertically extending structure using a pincer-type clamps that exert inward force between two sides of a wall or door for securing the mechanism. None use a bracket that surrounds a post.

Another known portable exercise device requires bolting to a vertical structure. This necessarily requires the vertical structure to have holes in it, or necessitates damage to the vertical structure. Alternatively, it requires that the portable device come with a post and supporting means that can be used with the exercise machine.

SUMMARY OF INVENTION

A post-mountable exercise apparatus includes an exercise device, a 3-walled bracket and a bridge. The exercise device has a frame that supports a horizontal shaft rotatably mounted in the frame such that two crank arms extending outside the first side and the second side of the frame can be rotated to turn the horizontal shaft. An opening in both the front and rear of the frame may be used for joining the frame to the bridge and consequently to the 3-walled bracket. A first turnable knob may be used to connect with a threaded hole or stud on the bridge.

A bridge fits into the 3-walled bracket and across the open face of the 3-walled bracket such that pulling or pushing the bridge also pulls or pushes, respectively, the 3-walled bracket. The threaded hole or stud is used to join the bridge to the frame. A pliant band may be included that can be adjusted for tension so as to change rotational resistance experienced by the horizontal shaft.

A band tensioning device using a threaded member may be added so that tightening or loosening the threaded member causes a change in the tension in of the pliant band.

Two friction pads may be added to the rear side of the frame to inhibit slipping of the apparatus once it is mounted on a pole.

One or more spacers may be removably secured to the 3-walled bracket so as to diminish an inside distance and better fit around a pole.

An alignment device may be included. The alignment device includes a locking shaft protruding out of at least one side of the frame, preferably out of both the first side and the second side of the frame. The protruding part of the locking shaft fits within a void at a rear edge of the 3-walled bracket. Alternatively the alignment device may be a guiding material placed on the bridge to constrain contact with the frame into a single position.

Technical Problem

A lightweight and portable upper body ergometer that is readily attachable by surrounding a post is needed to enable users to quickly and easily perform regular exercises in a gym or physical therapy environment. Upper Body Ergometers (UBE's) commercially available are typically large and heavy, or do not have the resistance range suitable for gym-type applications.

Portable rotary exercise devices in general use a pincer clamp that often has insufficient grasping potential to avoid slippage during use. These can cause the device to slip on an affixing door or other vertical structure. Also, using a door often means using an inconvenient location that gets in the way of transit into or out of a gym.

Portable rotary exercise devices typically use a clamp securing mechanism, which provides a small area of contact with a vertical structure, such as a door, and as a result must be tightened to the extent that damage to the door can be done. If the securing mechanism is not sufficiently tightened, slippage can occur disrupting the exercise routine. If it is sufficiently tightened, it can cause denting or damage to the door or wall.

Solution to Problem

The solution is a post-mountable exercise apparatus that is lightweight, portable and easily installed on a post with a bracket that surrounds the post. A rotary exercise device within a frame and is attachable to the bracket that enables a tight and unmovable connection to the post, without damaging the post. The bracket has a U-shape that fits around the far side of the post. A bridge inserts into the bracket on the near side of the post. The bridge encloses the post within the bracket. The bracket with the bridge installed is freely movable up and down the post to enable a user to locate it at a convenient spot for use. The bridge has either a threaded hole to receive a bolt or a stud projecting out from the bridge so that the frame holding the exercise device may then be secured to the bridge and draw the bracket in for a tight fit surrounding the post. The user can then engage in upper body ergometer-type exercises using the rotary exercise device. When a pliant band is included in the exercise device, it enables lightweight and simple adjustment of the rotational resistance from easy to very hard.

A portable ergometer with a bracket system that surrounds a post provides ability to tighten the exercise device to the post with a greater area pressing against the post for greater resistance to movement once the bracket is tightened in place.

Advantageous Effects of Invention

The post-mountable exercise apparatus has a unique means for attaching an exercise device to a vertical post at the exercise location. It uses a bracket that surrounds the post, rather than simply pressing against two sides of a post. The bracket requires no special tools and preferably uses hand operable handles or knobs for tight installation and subsequent removal from the post.

The post-mountable exercise apparatus facilitates human rotary arm exercise motions (a.k.a. Upper Body Ergometer) in standing or sitting positions while mounted on a post-type structure (e.g., Power Racks commonly used in gyms).

The post-mountable exercise apparatus has no heavy parts and as a consequence is lightweight and easily transported to a gym for use in a repetitive exercise regimen.

The post-mountable exercise apparatus has an optional pliant band that enables easy adjustment of the rotational resistance of the exercise device.

BRIEF DESCRIPTION OF DRAWINGS

The drawings illustrate preferred embodiments of the post-mountable exercise apparatus according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural changes may be made, without departing from the scope of the present invention.

Figure 1:
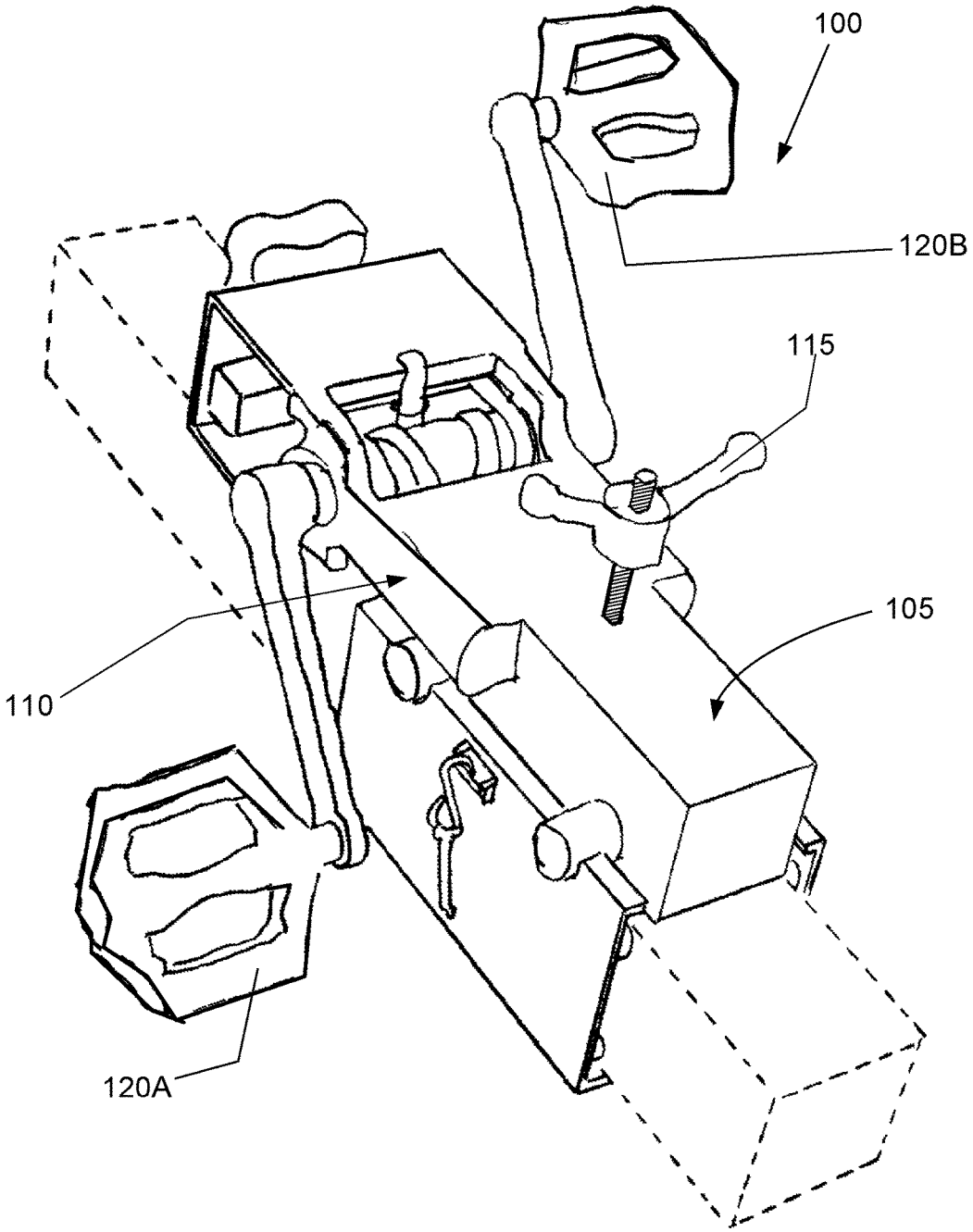
FIG. 1 is a perspective view of the post-mountable exercise apparatus assembled on a post.

FIG. 1 is a perspective view of the post-mountable exercise apparatus (100), which is shown assembled on a post. The post is displayed in dashed lines to indicate that it is not a part of the claimed invention, but is merely representative of one implementation mounted on a post with a rectangular cross-section. In other implementations, the post could be round in cross-section or have other shapes in cross-section. Typically, the post would be within a building and serve as a support for other exercise equipment.

The post-mountable exercise apparatus (100) includes an exercise device (200), a 3-walled bracket (305), and a bridge (325). It is portable in the sense that it can be carried to a gym or physical therapy location and installed on a support post that may be present in a building, that may be on an exercise machine such as a power rack commonly found in gyms or that may be added by, for example, an extendable pole.

Figure 2:
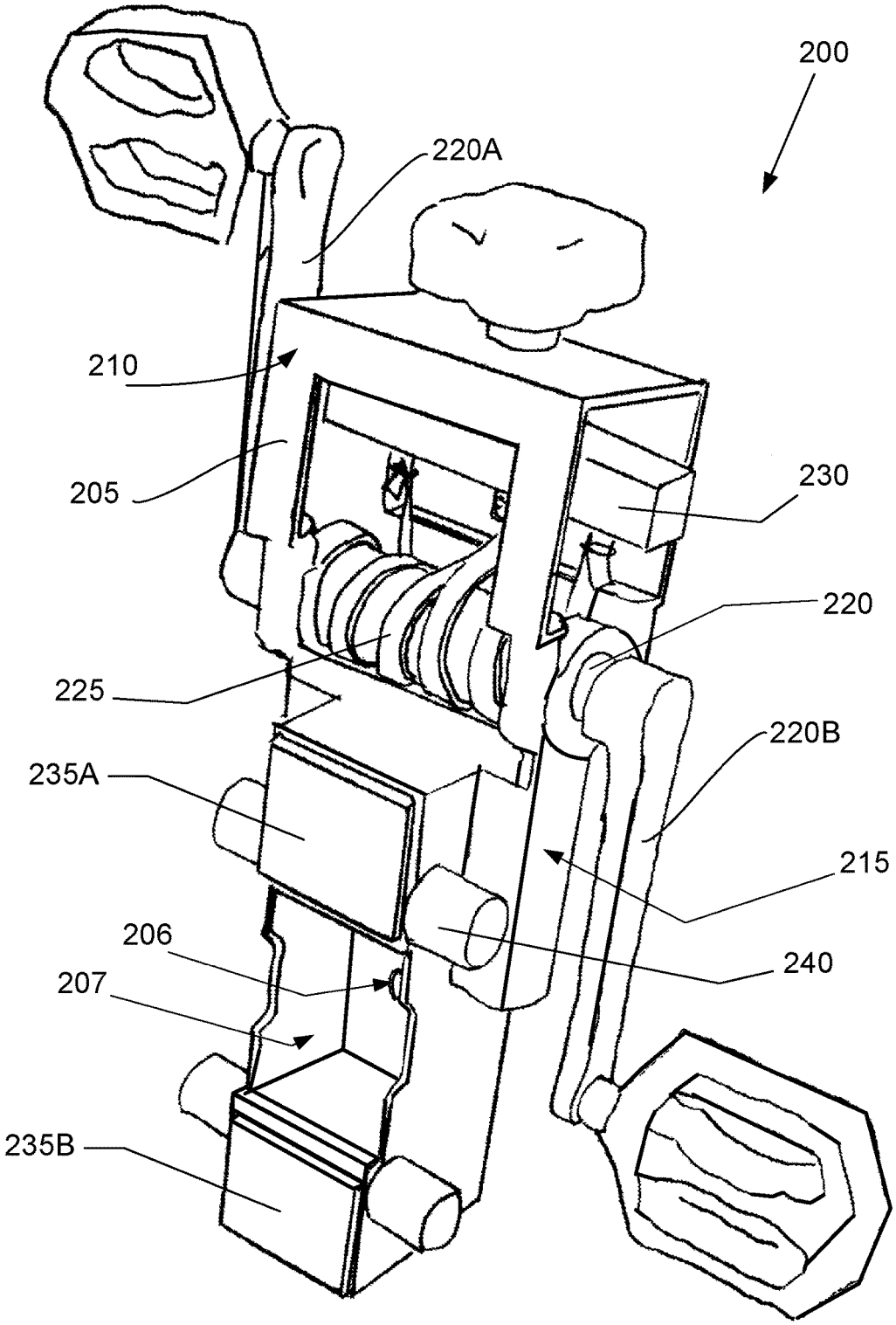
FIG. 2 is a perspective view of a frame.

The exercise device (200), illustrated in FIG. 2, includes a frame (205) and a first turnable knob (115). The frame (205) generally has four sides to it. The frame (205) defines a front side (105), a rear side (210), a first side (110) and a second side (215). The names of the sides are not significant and are designated to help identify what is described herein and explain the frame (205) and its interconnection with the other components.

The frame (205) supports a horizontal shaft (220) that is rotatably mounted in the frame (205). A rotatable mount is preferably accomplished using bearings holding the horizontal shaft (220) at the first side (110) and the second side (215) of the frame (205). The horizontal shaft (220) rotates by action using two crank arms, illustrated in FIG. 2 as a left crank-arm (220A) and a right crank-arm (220B). The two crank arms would typically have a hand hold or a foot pedal that would be used by a person exercising by rotating the pedals, illustrated in FIG. 1 as a left pedal (120A) and a right pedal (120B), or crank arms in a circular motion. "J" shaped hand holds are an example of an implementation used in place of flat pedals, often deemed best when used for foot pedaling.

The horizontal shaft (220) extends outside the first side (110) and the second side (215) of the frame (205). The front side (105) of the frame (205) defines a front opening (206). Similarly, the rear side (210) of the frame (205) defines a rear opening (207), which is preferably, but not necessarily, opposite to the front opening (206). Thus, the front opening (206) and the rear opening (207) are preferably aligned opposite to each other on the frame (205).

The first turnable knob (115) is configured to attach to a joining device, or to be a part of a joining device, that fits through the front opening (206) and engages with the bridge (325) to secure the frame (205) to the 3-walled bracket (305). The first turnable knob (115) may be of a type turnable by hand, or may be of a type such as a nut for turning with a tool. Any compatible joining device may be used, but is preferably either a stud projecting from the bridge (325) and extending through the front opening (206), or the first turnable knob (115) with a projecting threaded rod for threadable engagement with the bridge (325).

Figure 3:
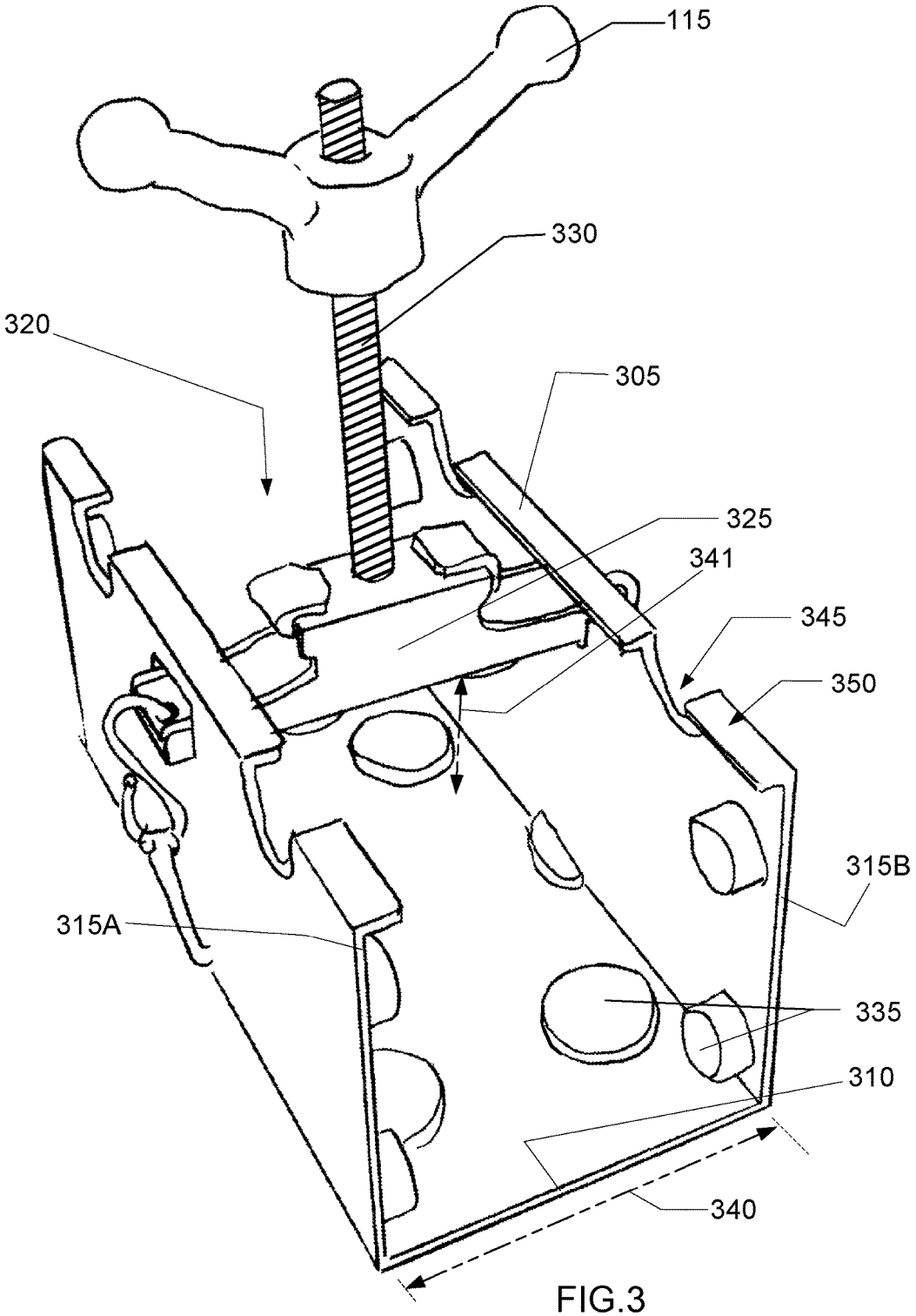
FIG. 3 is an end view of perspective view of a 3-walled bracket.

The 3-walled bracket (305), illustrated in FIG. 3, is similar to a structural channel or C-beam. The 3-walled bracket (305) defines a front wall (310), two side-walls, namely a left side-wall (315A) and a right side wall (315B), and an open face (320) opposite the front wall (310). Here again, the names of the sides are not significant and are designated to help identify what is described herein and explain the 3-walled bracket (305) and its interconnection with the other components. The 3-walled bracket (305) may have perpendicular sides suitable for use with square poles. Alternatively the 3-walled bracket (305) may be rounded like a U-bolt for round posts.

Figure 4:
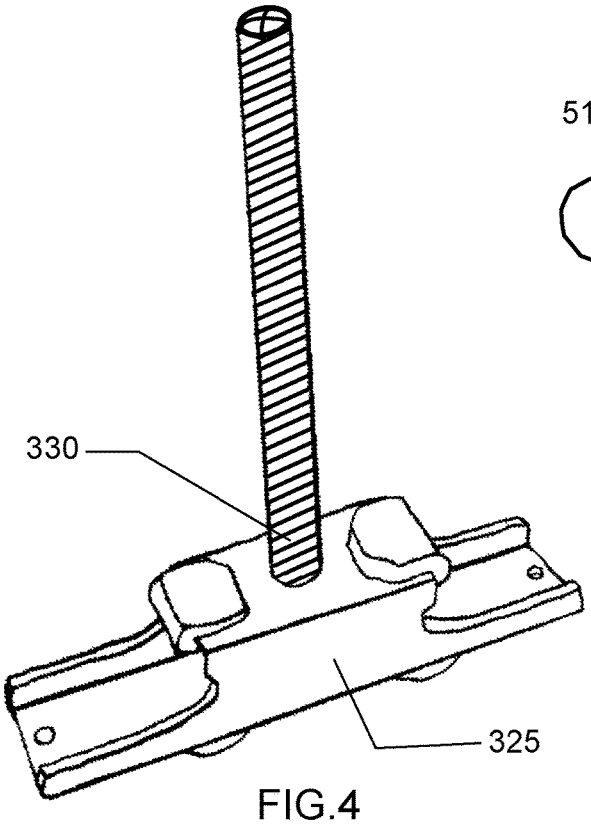
FIG. 4 is a perspective view of a bridge with a stud.

The bridge (325) is a cross-piece that fits into the 3-walled bracket (305) near the edges of the open face (320). The bridge (325) spans, i.e. fits across, the open face (320) of the 3-walled bracket (305) and interlocks with the 3-walled bracket (305) such that pulling or pushing the bridge (325) also pulls or pushes, respectively, the 3-walled bracket (305). The bridge (325) includes the joining device, preferably either a threaded connection (605) or stud (330), shown in FIG. 3 and FIG. 4, for connecting to the frame (205).

Figure 5:
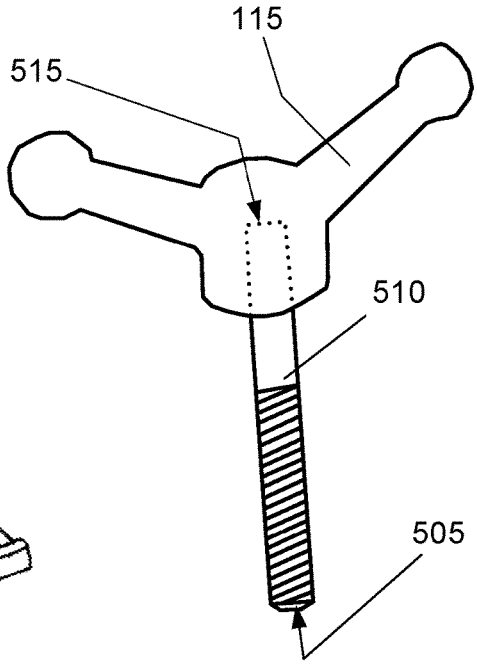
FIG. 5 is a perspective view of a first turnable knob atop a first threaded rod.
Figure 6:
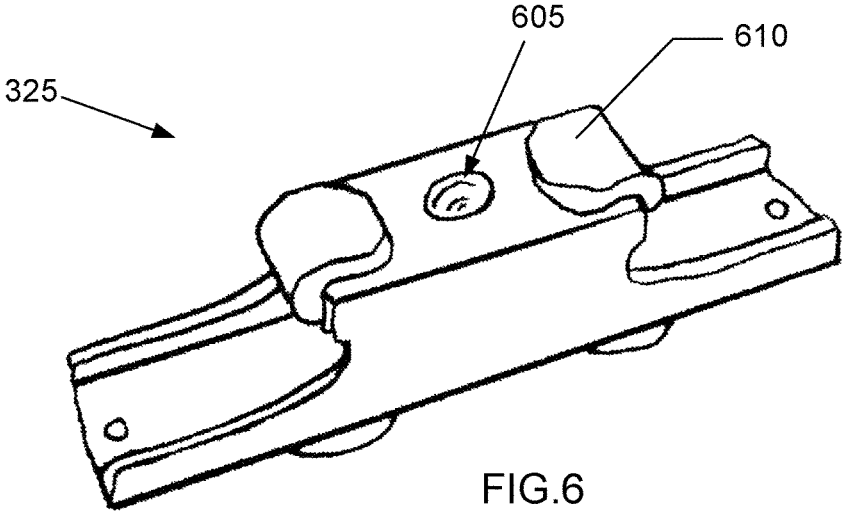
FIG. 6 is perspective view of a bridge with a threaded connection configured to receive the first threaded rod.

When the threaded connection (605) is present in the bridge (325), it is configured to engage with a first end (505) of a first threaded rod (510), shown in FIG. 5. Preferably, this means that the first threaded rod (510) is screwed into the threaded connection (605), illustrated in FIG. 6. For this embodiment, the first turnable knob (115) is preferably permanently attached to a second end (515) of the first threaded rod (510). The first threaded rod (510) can then fit through the front opening (206) of the frame (205) to threadably engage with the threaded connection (605). Thereafter, rotation of the first threaded rod (510) into or out of the threaded connection (605) joins together the bridge (325) and thus also the 3-walled bracket (305) and the frame (205).

When the stud (330) is present in the bridge (325), it projects outward from the bridge (325). The stud (330) is configured with a length and diameter to fit through the front opening (206) in the frame (205) a sufficient distance to add a nut and tighten against the frame (205) to hold together the frame (205), the bridge (325), and the 3-walled bracket (305). Preferably, the stud engages with the first turnable knob (115) so that tightening the first turnable knob (115) on the stud (330) up against the frame (205) firmly draws together the 3-walled bracket (305) and the frame (205).

The post-mountable exercise apparatus (100) may further include a pliant band (225) configured so that adjusting tension on the pliant band (225) adjust the rotational resistance of the horizontal shaft (220). The pliant band (225) is preferably an integral part of the exercise device (200), but may be an independent component added to improve the ability to change the resistance to rotation of the horizontal shaft (220). The pliant band (225) is typically webbing or rope that may be wrapped around the horizontal shaft (220) with varying degrees of tension. Wrapping may be done manually or by using band tensioning device. Being able to vary the tension in the wrap enables changing the rotational resistance experienced by the horizontal shaft (220) and thus the resistance felt by a person turning the two crank arms.

When the pliant band (225) is present, there is preferably a band tensioning device to make it easier to change the tension in the pliant band (225). Preferably, this device includes a threaded member (705) that is connected to the frame (205) with a threadable bolt-like connection so that turning the bolt one way or the other also pushes against the pliant band (225) to increase or decrease the tension in the pliant band (225).

Three types or variations in the band tensioning device are considered preferable.

In a first type, the threaded member (705) turns in a cross bar (230) that contacts the pliant band (225). Rotation of the threaded member (705) moves the cross bar (230) to causes a change in the tension in of the pliant band (225). The change may be increasing the tension by further engaging the pliant band (225). The change may also be decreasing the tension by diminishing the contact with the pliant band (225).

Figure 7:
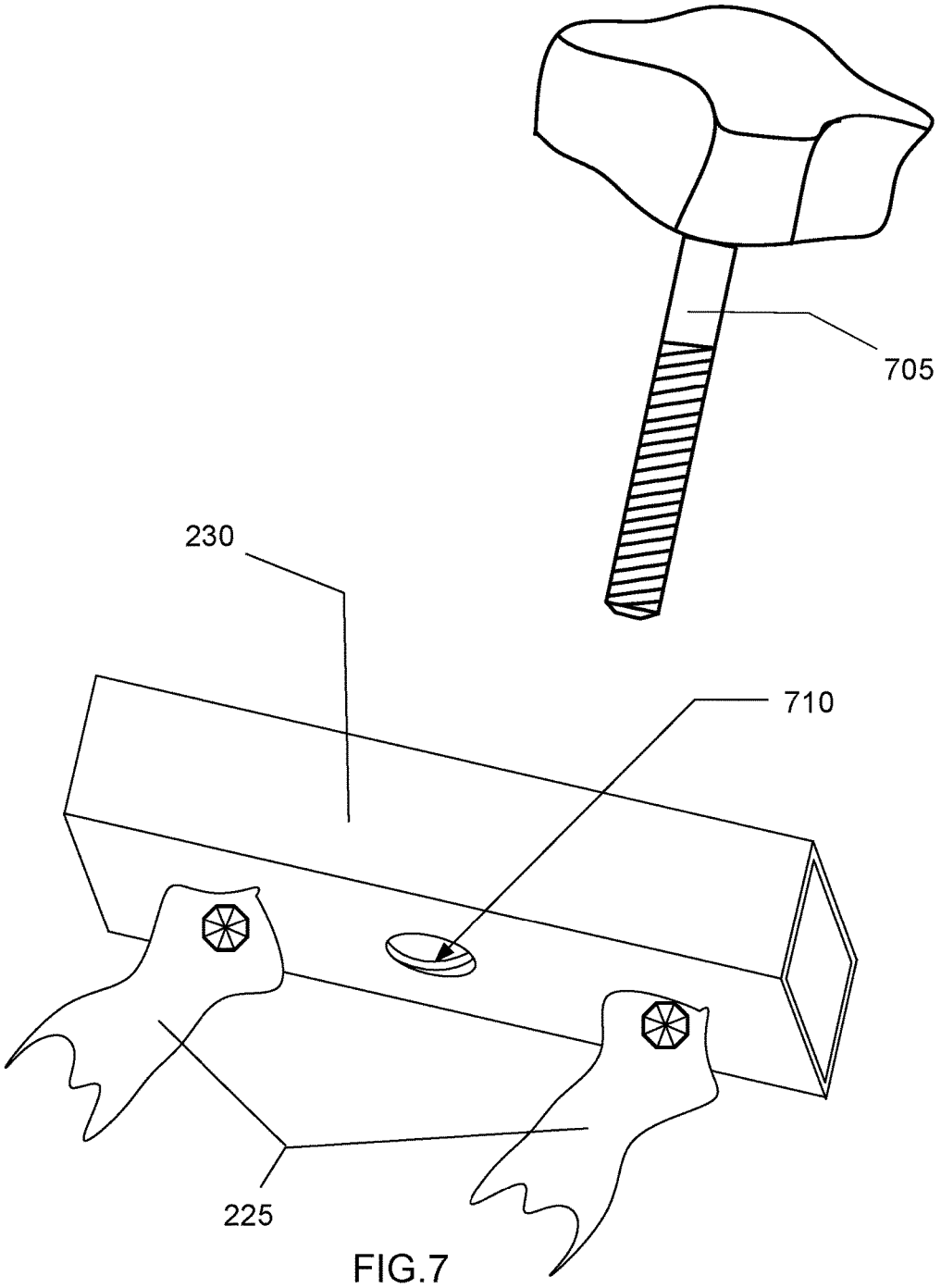
FIG. 7 is a perspective view of a cross bar showing threads configured to engage with the threaded member once the threaded member is inserted through the front opening of the frame.

In a second type, illustrated in FIG. 7, a threaded member (705) is restrained by the frame (205) and is configured to engage with threads (710) in a cross bar (230). The pliant band (225) is restrained to the frame (205). The pliant band (225) is looped around the horizontal shaft (220). The pliant band (225) is further restrained by the cross bar (230). And rotation of the threaded member (705) causes a change in the tension in the pliant band (225).

In a third type, a threaded member (705) is configured for rotation and to engage with threads (710) in a cross bar (230). The pliant band (225) is restrained by the cross bar (230). The pliant band (225) is looped around the horizontal shaft (220). And, when the threaded member (705) is rotated after it is engaged with the threads (710) in the cross bar (230), this rotation moves the cross bar (230) which in turn causes a change in the tension in the pliant band (225).

A variety of different wraps and attachment points of the pliant band (225) are possible. Looping the pliant band (225) more than one time is preferred to effect a greater amount of resistance to rotation of the horizontal shaft (220).

Example 1 of a Pliant Band

In one exemplary embodiment, the frame (205) includes multiple horizontal shafts to enable wrapping the pliant band (225) in a variety of ways to enable manipulation for changing the tension in the pliant band (225) and thus the resistance to rotation of the horizontal shaft (220). In such an embodiment, the pliant band (225) is wrapped around the horizontal shaft (220) and then wrapped around a second horizontal shaft. Then a user desiring to change the rotational resistance of the horizontal shaft (220) either relaxes or further tightens the pliant band (225). Manipulation of the tension in the pliant band (225) can be easily accomplished by a cross-bar acting against the pliant band (225) either by increasing engagement with the pliant band (225) or by decreasing engagement with the pliant band. The pliant band (225) may be configured to hold one or two ends of the pliant band (225) and to then be moved one way or the other for increasing or decreasing tension in the pliant band (225). Movement of the cross-bar may be manipulated by a hand turnable knob connected to the cross-bar and is screwed further into or out of the frame. In any case, adjusting tension on the pliant band (225), results in changes in an amount of rotational resistance experienced by the horizontal shaft. (220).

Example 2 of a Pliant Band

In a second exemplary embodiment, a preferred wrap of the pliant band (225) is used. For this preferred wrap, a middle section of the pliant band length is looped with twists around an upper first rod within the frame (205). The ends of the pliant band (225) are then looped around a second rod. Then, the ends of the pliant band (225) are wrapped three times or more with twists around the horizontal shaft (220). The ends of the pliant band (225) then route through rotating bushings in a third member. Finally, the tail ends are then secured to frame. A second knob/threaded rod then engages threads in the third member such that it pulls on the pliant band (225) and tightens it as it wraps around the horizontal shaft (220). The tighter the pliant band (225) gets, the harder it is to rotate the horizontal shaft (220).

The post-mountable exercise apparatus (100) preferably, but optionally, includes two friction pads: namely an upper friction-pad (235A) and a lower friction-pad (235B), located on the rear side (210) of the frame (205). These friction pads help to keep the frame in place on the post.

The post-mountable exercise apparatus (100), optionally includes at least one spacer (335) that is secured to the 3-walled bracket (305) so as to diminish an inside-distance (340) or the depth-distance (341) between the inside front wall of the 3-walled bracket (305) and the location of the bridge (325). Multiple spacers may be used to aid in making a tight fit between the 3-walled bracket (305), the frame (205) and the post to which they are attached. The spacers may be removable attached.

The post-mountable exercise apparatus (100) may include an alignment device that positions the frame (205) and the 3-walled bracket (305) in the same position that is best for screwing them together against the post. This alignment device is preferably a structural configuration where the components of both the frame (205) and the 3-walled bracket (305) fit together always in a single position. Three implementations of the alignment device are preferred.

In a first implementation, a locking shaft (240) extends out of the first side (110) of the frame (205) to be a protrusion from the frame (205). In other words the locking shaft (240) extends horizontally beyond the first side (110) of the frame (205). In this first implementation, the locking shaft (240) is preferably unmovably fixed to the frame (205).

In this first implementation, at least one of the two side-walls of the 3-walled bracket (305) defines a void (345) at a rear edge (350). The void (345) is configured to receive the locking shaft (240), i.e. the protrusion extending beyond the first side (110), so as to prevent sliding of the frame (205) with respect to the 3-walled bracket (305).

In a second implementation, a locking shaft (240) extends out of the second side (215) of the frame (205) to be a protrusion from the frame (205). In other words, the locking shaft (240) extends horizontally beyond the second side (215) of the frame (205). In this second implementation, the locking shaft (240) is preferably unmovably fixed to the frame (205).

For either the first implementation or the second implementation, the locking shaft (240) may protrude from both sides of the frame (205), as shown in FIG. 2. When so configured, the locking shaft (240) extends symmetrically through the first side (110) and the second side (215) of the frame (205). Preferably, the locking shaft (240) is horizontal when the post-mountable exercise apparatus (100) is installed on a vertical post.

In the first implementation and the second implementation, at least one of the two side-walls of the 3-walled bracket (305) defines a void (345) at a rear edge (350). The void (345) is configured to receive the locking shaft (240), i.e. the protrusion, so as to prevent sliding of the frame (205) with respect to the 3-walled bracket (305). Preferably, there are two voids and two protrusions for a symmetrical appearance.

In a third implementation, a guiding material (610) is placed on the bridge (325) to constrain contact with the frame (205) into a single position. The guiding material (610) is a piece of plastic edge trim placed on the outside upper lips of the bridge. The plastic edge trip rides against the inside of the frame (205) so as to laterally align the bridge (325) with the frame (205) when they are moved into locking position, to wit, the position at which the frame (205) is securely tightened to the bridge (325) and consequently the 3-walled-bracket (305).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the exercise device industry.

What is claimed is:

1. A post-mountable exercise apparatus comprising:

an exercise device comprising:

a frame, the frame defining a front side, a rear side, a first side and a second side, the frame supporting a horizontal shaft rotatably mounted in the frame such that two crank arms extending outside the first side and the second side of the frame can be rotated to turn the horizontal shaft, the front side defining a front opening and the rear side defining a rear opening;

a first turnable knob for attachment to a joining device fitting through the front opening;

a 3-walled bracket defining a front wall, two side-walls and an open face opposite the front wall; and a bridge fitting into the 3-walled bracket and across the open face of the 3-walled bracket such that pulling or pushing the bridge also pulls or pushes, respectively, the 3-walled bracket, the bridge comprising the joining device for connecting to the frame, the joining device selected from the group consisting of:

a threaded connection configured to engage with a first end of a first threaded rod, the first threaded rod configured to connect with the first turnable knob at a second end and fit through the front opening of the frame to threadably engage with the threaded connection so that rotation of the first threaded rod into or out of the threaded connection to draw together the 3-walled bracket and the frame, and a stud projecting from the bridge and configured to fit through the front opening in the frame for threadably connecting with the first turnable knob so that tightening the first turnable knob on the stud draws together the 3-walled bracket and the frame.

2. The post-mountable exercise apparatus of claim 1, further comprising a pliant band configured so that adjusting tension on the pliant band, results in a change in an amount of rotational resistance experienced by the horizontal shaft.

3. The post-mountable exercise apparatus of claim 2, further comprising a band tensioning device, wherein the band tensioning device is selected from the group consisting of:

a threaded member turning in a cross bar that contacts the pliant band, wherein rotation of the threaded member causes a change in the tension in of the pliant band;

a threaded member restrained by the frame and configured to engage with threads in a cross bar, wherein:

the pliant band is restrained to the frame, the pliant band is looped around the horizontal shaft, the pliant band is further restrained by the cross bar, and rotation of the threaded member causes a change in the tension in the pliant band; and a threaded member configured for rotation and to engage with threads in a cross bar, wherein:

the pliant band is restrained by the cross bar, the pliant band is looped around the horizontal shaft, and when the threaded member is rotated once engaged with the threads in the cross bar, moves the cross bar which in turn causes a change in the tension in the pliant band.

4. The post-mountable exercise apparatus of claim 1, further comprising two friction pads located on the rear side of the frame.

5. The post-mountable exercise apparatus of claim 1, further comprising a spacer secured to the 3-walled bracket so as to diminish an inside distance.

6. The post-mountable exercise apparatus of claim 1, further comprising an alignment device, wherein the alignment device is selected from the group consisting of:

a locking shaft extending horizontally beyond the first side of the frame, the locking shaft being unmovably fixed to the frame wherein at least one of the two side-walls of the 3-walled bracket defines a void at a rear edge, the void configured to receive the locking shaft so as to prevent sliding of the frame with respect to the 3-walled bracket a locking shaft extending horizontally beyond the second side of the frame, the locking shaft being unmovably fixed to the frame wherein at least one of the two side-walls of the 3-walled bracket defines a void at a rear edge, the void configured to receive the locking shaft so as to prevent sliding of the frame with respect to the 3-walled bracket; and a guiding material placed on the bridge to constrain contact with the frame into a single position.

* * * * *